US008439100B2

(12) United States Patent
Panseri et al.

(10) Patent No.: US 8,439,100 B2
(45) Date of Patent: May 14, 2013

(54) MODULAR UPRIGHT FOR SERVICE DOOR WITH FLEXIBLE CURTAIN

(75) Inventors: Anne-Sophie Panseri, Montanay (FR); Antonello La Marca, Corbas (FR); Romain Simon, Caluire (FR)

(73) Assignee: Maviflex, Decines Charpieu (FR)

( * ) Notice: Subject to any disclaimer, the term of this patent is extended or adjusted under 35 U.S.C. 154(b) by 116 days.

(21) Appl. No.: 12/668,071

(22) PCT Filed: Jul. 11, 2008 (Under 37 CFR 1.47)

(86) PCT No.: PCT/FR2008/001016
§ 371 (c)(1), (2), (4) Date: Jul. 22, 2010

(87) PCT Pub. No.: WO2009/034265
PCT Pub. Date: Mar. 19, 2009

(65) Prior Publication Data

US 2011/0167729 A1 Jul. 14, 2011

Related U.S. Application Data

(60) Provisional application No. 60/954,087, filed on Aug. 6, 2007.

(30) Foreign Application Priority Data

Jul. 12, 2007 (FR) ..... 07 05050

(51) Int. Cl.
*E06B 9/17* (2006.01)

(52) U.S. Cl.
USPC ..... 160/271; 160/268.1; 160/188

(58) Field of Classification Search ..... 160/271, 160/201, 208, 84.06, 268.1, 266, 272, 270, 160/267.1, 188–189
See application file for complete search history.

(56) References Cited

U.S. PATENT DOCUMENTS 1,880,589 A * 10/1932 Traut ..... 160/271
2,041,105 A * 5/1936 Barnhart ..... 160/31

(Continued)

FOREIGN PATENT DOCUMENTS

FR 2 885 946 A1 11/2006
WO WO 98/48139 A1 10/1998
WO WO 01/053648 A1 7/2001

OTHER PUBLICATIONS

International Search Report, dated Mar. 18, 2009, from corresponding PCT application.

*Primary Examiner* — Katherine Mitchell
*Assistant Examiner* — Johnnie A Shablack
(74) *Attorney, Agent, or Firm* — Young & Thompson

(57) ABSTRACT

A vertical modular mount for a handling door (1) includes an upper plate (18) connected to a horizontal frame (4) and more particularly to a side flange (19), a lower plate (20) connected to the ground, a central web (21) connecting the upper (18) and lower (20) plates together, a cloth (23) arranged around the upper (18) and lower (20) plates in order to define an envelope (24) on the entire height of the mount (2, 3), and a guiding device (15) defining a slide for the movement of the flexible screen (6), characterized in that each of the members (21, 23, 15) forming the mounts (2, 3) of the handling door (1) are arranged so as to impart a high resilience to the latter, i.e. a high resistance to shocks due to the elastic deformation of each of the members.

20 Claims, 6 Drawing Sheets

U.S. PATENT DOCUMENTS 2,350,288 A * 5/1944 Michelman ..... 160/133
4,232,309 A * 11/1980 Dillitzer ..... 340/547
4,357,978 A * 11/1982 Keller et al. ..... 160/41
4,369,829 A * 1/1983 Casiday ..... 160/120
4,647,488 A * 3/1987 Schnebly et al. ..... 428/116
4,846,244 A * 7/1989 Rosenfeld ..... 160/201
4,930,563 A * 6/1990 Finch et al. ..... 160/271
5,099,905 A * 3/1992 Rigter ..... 160/273.1
5,219,015 A * 6/1993 Kraeutler ..... 160/271
5,379,823 A * 1/1995 Kraeutler ..... 160/271
5,601,134 A * 2/1997 Pinkalla et al. ..... 160/271
5,964,270 A * 10/1999 Kirkey et al. ..... 160/273.1
6,085,825 A * 7/2000 Swink et al. ..... 160/188
6,152,207 A * 11/2000 Varley ..... 160/264
6,192,960 B1 * 2/2001 Simon ..... 160/84.06
6,247,517 B1 * 6/2001 Drifka et al. ..... 160/23.1
6,405,781 B2 * 6/2002 Davies et al. ..... 160/23.1
6,481,487 B2 * 11/2002 Simon ..... 160/84.06
6,666,251 B2 * 12/2003 Ikle ..... 160/120
6,715,531 B2 * 4/2004 Simon ..... 160/271
7,017,644 B1 * 3/2006 Kraeutler ..... 160/271
7,093,643 B2 * 8/2006 Ikle ..... 160/120
7,151,450 B2 * 12/2006 Beggs et al. ..... 340/545.1
7,191,817 B2 * 3/2007 Nicolosi ..... 160/84.06
7,231,953 B2 * 6/2007 Varley et al. ..... 160/273.1
7,416,014 B2 * 8/2008 Coenraets ..... 160/273.1
7,762,304 B2 * 7/2010 La Marca et al. ..... 160/8
8,037,921 B2 * 10/2011 Dondlinger et al. ..... 160/268.1
2003/0155082 A1 * 8/2003 Simon et al. ..... 160/84.06
2003/0173041 A1 * 9/2003 Simon et al. ..... 160/267.1
2003/0205341 A1 * 11/2003 Simon et al. ..... 160/267.1
2008/0041537 A1 * 2/2008 Mullet et al. ..... 160/271
2008/0093037 A1 * 4/2008 Kraeutler ..... 160/271
2010/0006239 A1 * 1/2010 Kraeutler ..... 160/272

* cited by examiner

MODULAR UPRIGHT FOR SERVICE DOOR WITH FLEXIBLE CURTAIN

The present invention relates to a modular upright for curtain-type service doors for buildings and more particularly to opposite vertical uprights fastened to a guide device or slide for guiding the flexible curtain when it moves between an open position and a closed position.

BACKGROUND OF THE INVENTION

Vertical uprights are known in the art that consist of bent sheet metal slides, drawn aluminum slides or extruded plastic material slides.

By virtue of their structure and their shape these slides can also constitute the vertical uprights of a service door of the flexible curtain type.

These slides are generally produced in one part or at most two parts and have certain drawbacks in that they are exposed to impact with the risk of irreparable damage necessitating complete replacement.

There are also known from the applicant's patent No. EP 0979340 vertical service door uprights including taut flexible slides on a bent sheet metal structural section.

SUMMARY OF THE INVENTION

The modular service door upright of the present invention consists of a number of combined structural elements that are produced in different materials to provide total resilience and flexibility in order to be able to absorb impacts without risk of damaging said structural elements.

The modular service door vertical upright of the invention includes an upper plate fastened to the horizontal box section and more particularly to the lateral flange, a lower plate fixed to the ground, a central core connecting the upper plate and the lower plate together, a cloth fixed around the upper plate and the lower plate in order to constitute over the full height of the upright an envelope, and a guiding device constituting a slide for movement of the flexible curtain, and in that each element constituting the upright of the service door is adapted to make it very resilient, i.e. highly resistant to impact, because of the elastic deformation of each of its elements.

The service door modular vertical upright of the present invention has other essential features that are described in and protected by the secondary claims dependent directly or indirectly on the main claim.

BRIEF DESCRIPTION OF THE DRAWINGS

The appended drawings, provided by way of example, explain the invention, its features and the advantages that it can procure.

DETAILED DESCRIPTION OF THE PREFERRED EMBODIMENTS

Figure 1:
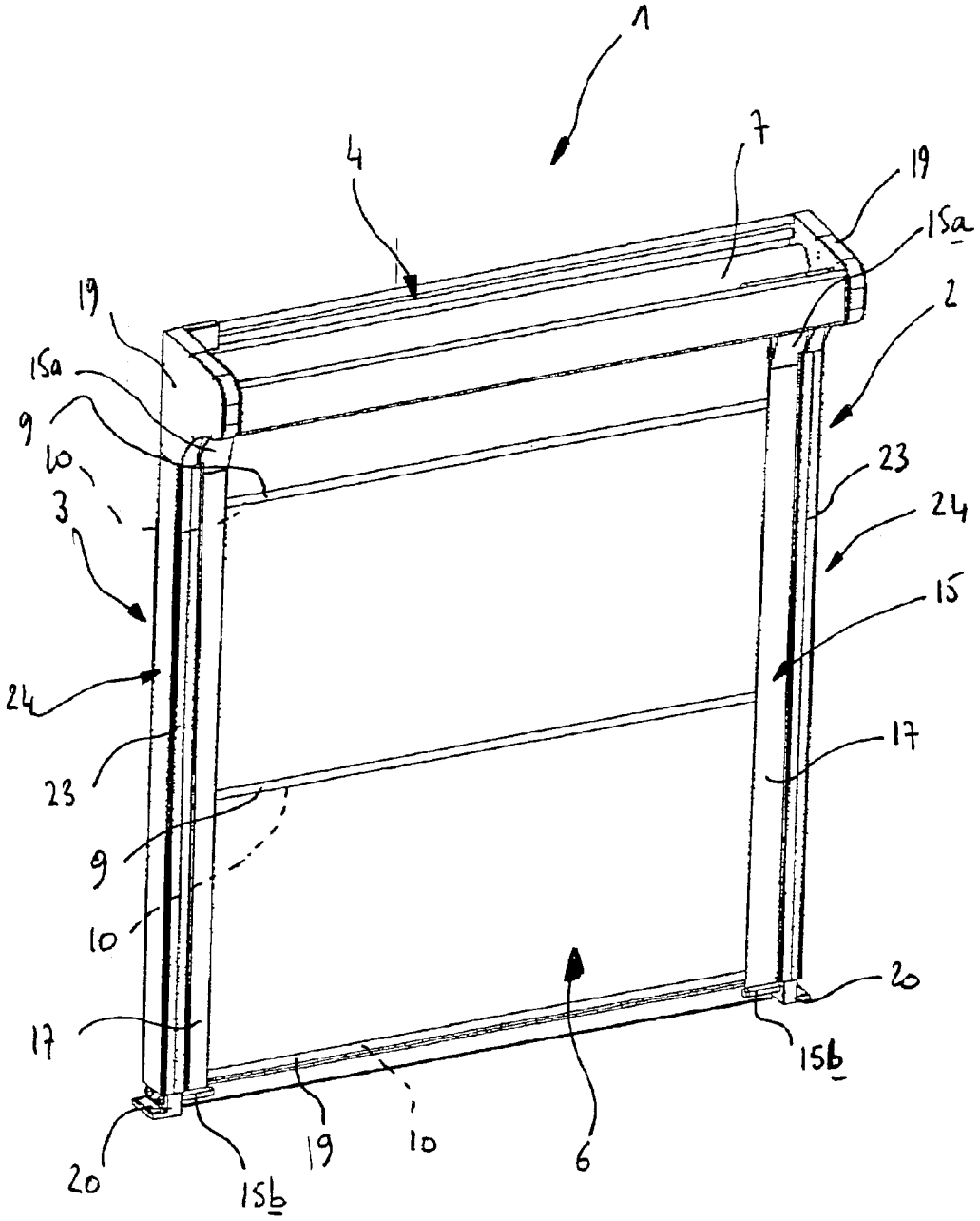
FIGS. 1 and 2 are perspective views showing a service door including modular uprights of the present invention.
Figure 2:
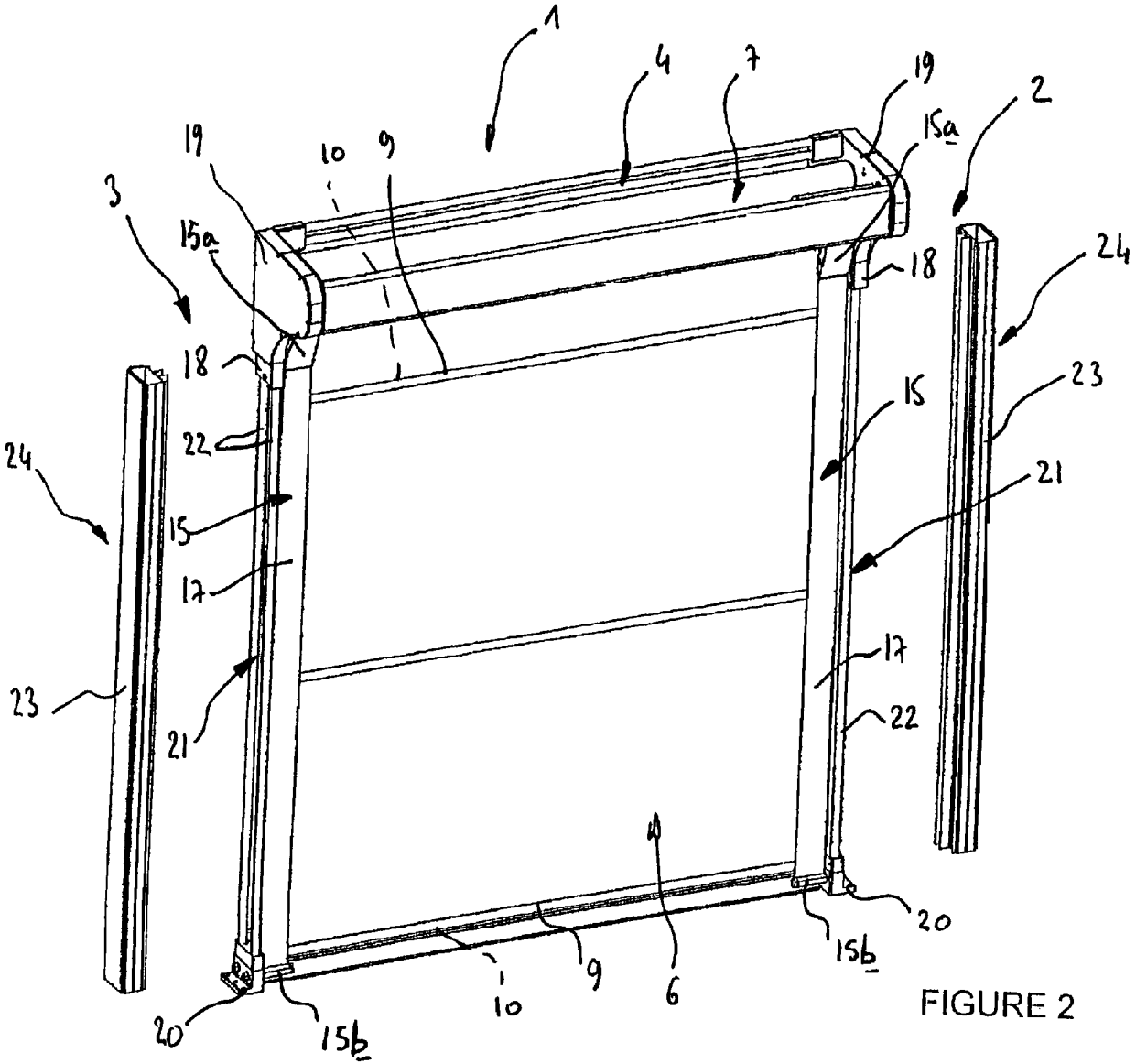
Figure 3:
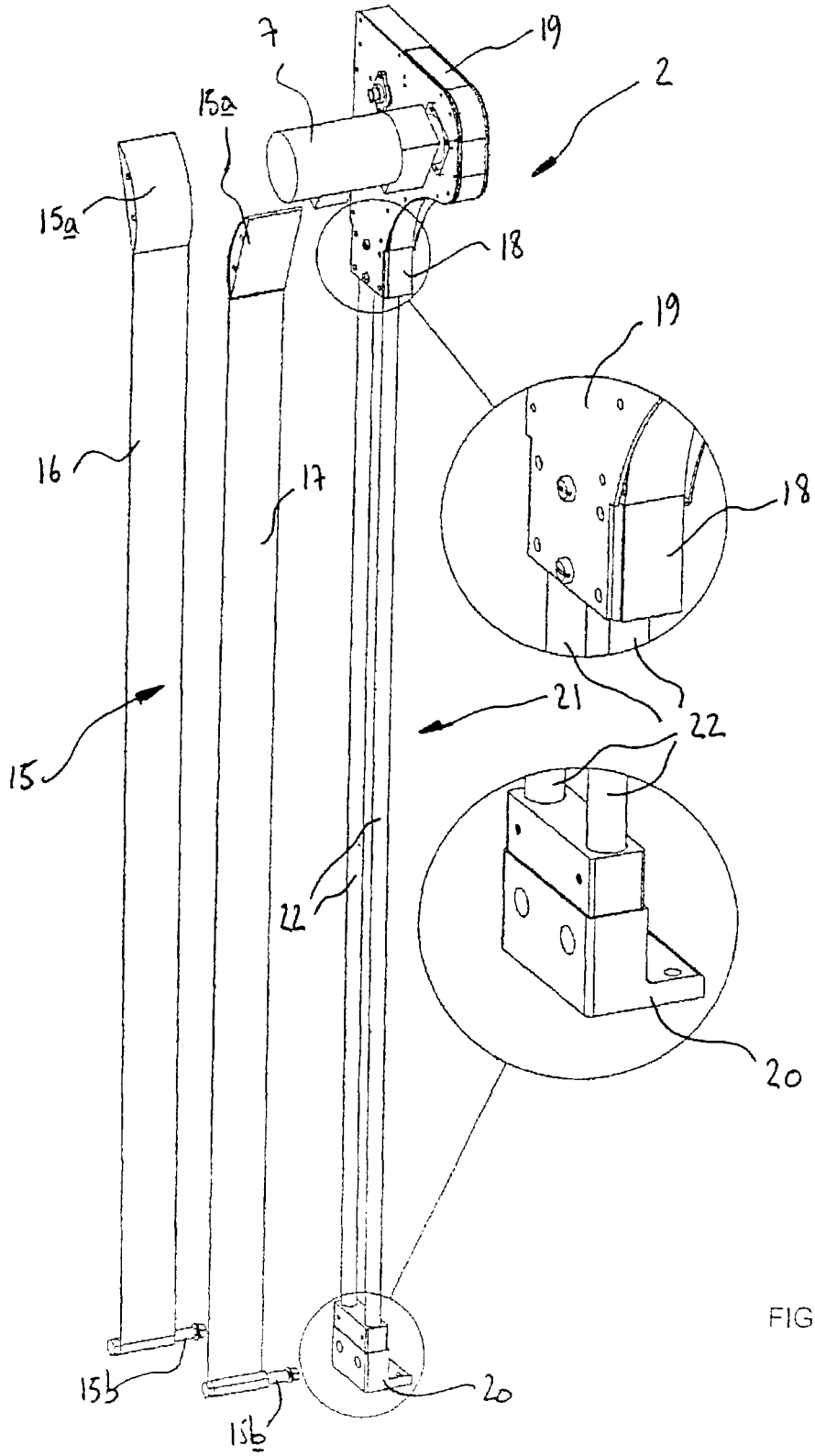
FIGS. 3 to 6 are perspective views representing in detail the structural elements constituting each service door modular upright of the present invention.

There is shown in FIGS. 1 and 2, by way of example, a service door 1 for industrial buildings including two opposite modular lateral uprights 2 and 3 connected together at the top by a horizontal box section 4. The modular lateral uprights 2 and 3 can be fixed or not at a certain distance from the face 5 of a wall, depending on the function of the service door 1.

In this example, the service door 1 is a roller door including in the horizontal box section 4 connecting the modular uprights 2 and 3 together a driving drum 7 for rolling and unrolling a flexible curtain 6 between an open position and a closed position.

The flexible curtain 6 includes sheaths 9 each of which receives inside it horizontal reinforcement crossmembers 10.

Each modular vertical upright 2, 3 includes a guiding device 15 for guiding the flexible curtain 6 and the horizontal reinforcement crossmembers 10 during vertical movement of said curtain between an open position and a closed position.

For example, the guiding device 15 provided on each modular upright 2, 3 can consist either of two taut straps 16, 17 or of two semi-rigid slats disposed face-to-face as described in the applicant's patents EP 0979340 and EP 1248892.

There are represented in FIGS. 3 to 6 the structural elements constituting the modular vertical upright 2 of the service door 1, the other modular vertical upright 3 being of identical construction.

Thus the modular upright 2 consists of an upper plate 18 fastened to the horizontal box section 4 and more particularly a lateral flange 19 for retaining the driving drum 7 of the service door 1 and guiding its rotation. The upper plate 18 is below and in line with the lateral flange 19 so as to face the ground in the opening receiving the service door 1.

The modular upright 2 includes a lower plate 20 with the same profile as the upper plate 18 which is fixed to the ground in the opening in which the service door 1 is to be installed.

The modular upright 2 includes a central core 21 connecting together the upper plate 18 and the lower plate 20. The central core 21 can consist of at least one tubular vertical structural section 22 produced for example in a composite or plastic material or in steel with a high elastic limit offering good deformation characteristics so that it can return to its original position after an impact.

The central core 21 can consist of two or four tubular structural sections 22, for example.

Figure 4:
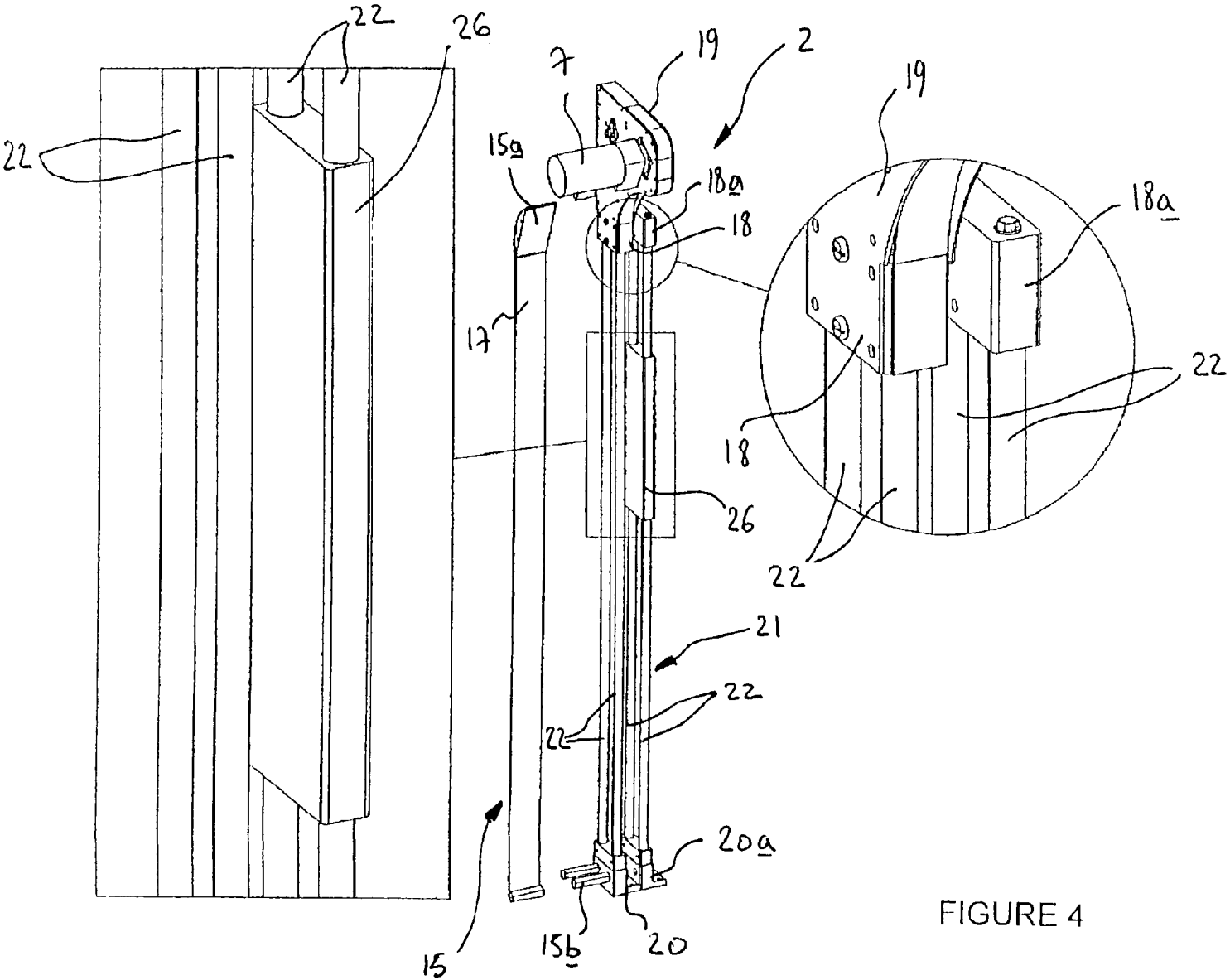
Figure 5:
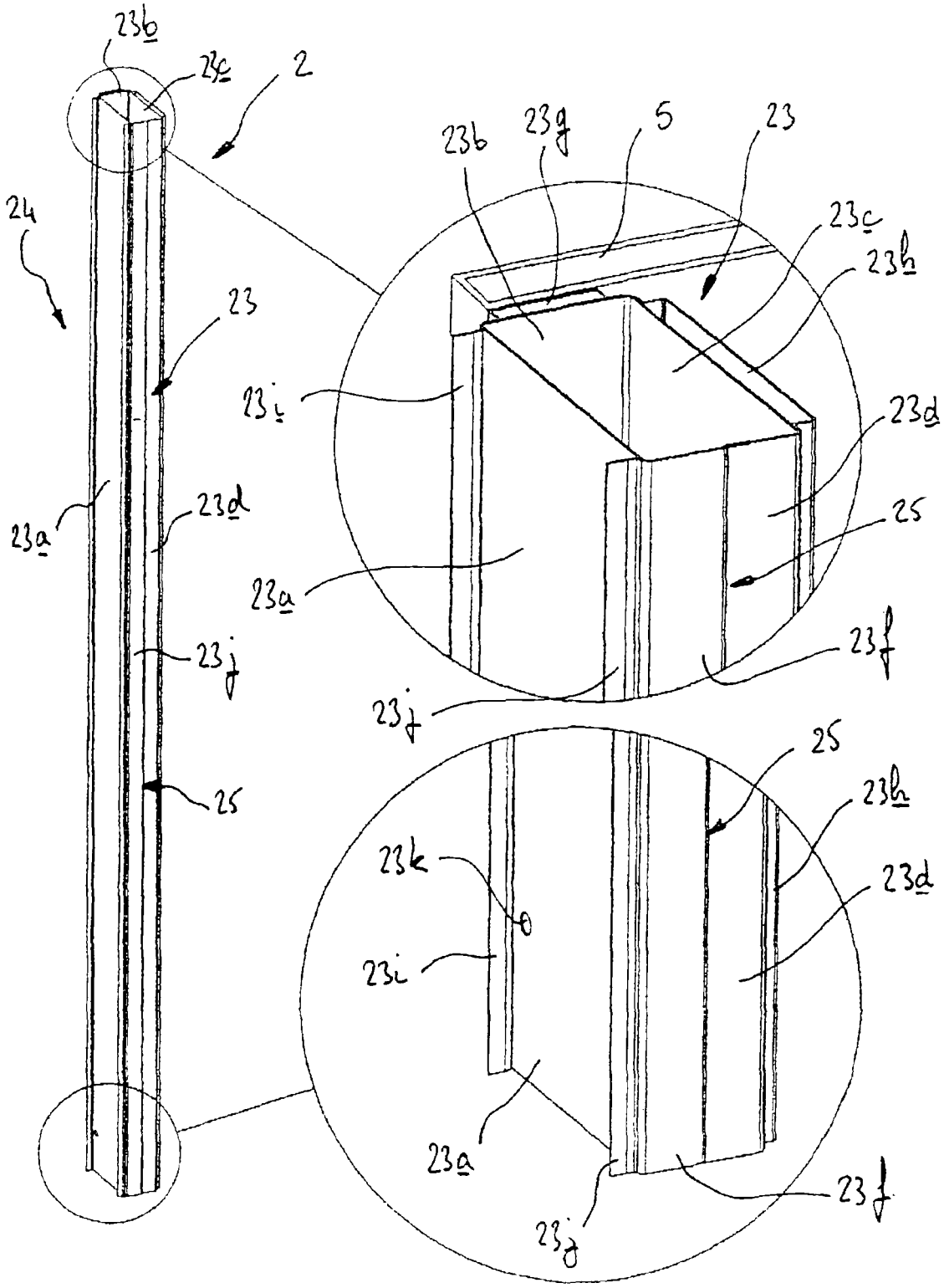

If the central core 21 consists of four tubular structural sections 22, for example, the first two tubular structural sections 22 are fixed between the upper plate 18 and the lower plate 20 and the other two tubular structural sections 22 are retained between two other plates, namely an upper plate 18*a* and a lower plate 20*a*, producing a framework for guiding and housing a counterweight 26 in a manner appropriate to the structure of the service door 1 (FIG. 4).

The modular vertical upright 2 includes a guiding device 15 consisting of two taut straps 16, 17 fixed in the upper plate 18 and the lower plate 20. Each taut strap 16, 17 includes in its upper portion an inclined shoe 15*a* fastened to the upper plate 18. The straps 16, 17 are fixed to the lower plate 20 by a tensioner 15*b* that can be rotated to adjust the tautness of said straps.

The modular upright 2 includes a cloth 23 that is produced in a single-skin or double-skin technical fabric similar to that used for the flexible curtain 6 and fastened around the upper plate 18 and the lower plate 20 to constitute over the full height of said upright an envelope 24 having an external profile similar to that of said plates 18, 20. The envelope 24 can also cover the upper plates 18, 18*a* and lower plates 20, 20*a* if the modular upright 2 includes a central core 21 consisting of four parallel tubular structural sections 22.

The envelope 24 consists of a cloth 23 with cloth panels 23*a*, 23*b*, 23*c*, 23*d* arranged and fixed, for example welded, together to follow the dimensions and external contour of the upper plate 18 and the lower plate 20 to cover the latter and the central core 21 of the modular upright 2.

The cloth panel 23*d* of the envelope 24 is slit over its full height to form two half-panels 23*e*, 23*f* to delimit an entry for fitting said envelope 24 around the upper plate 18 and the lower plate 20.

The two half-panels 23*e*, 23*f* are connected together by closure means 25 of the zip, popper, Velcro type to retain the envelope 24 around the upper plate 18 and the lower plate 20.

Facing the cloth panel 23*d* is the cloth panel 23*b* of the envelope 24 that is intended to come to bear against the face 5 of the wall receiving the service door 1. The cloth panel 23*b* has on its external face and over its full height a bead 23*g* that bears against the face 5 of the wall in order to provide a seal therewith.

The larger cloth panels 23*a*, 23*c* are perpendicular to the cloth panel 23*d* of the envelope 24. The cloth panel 23*c* has on its external face and over its full height a housing 23*h* through which electrical cables can be passed, for example.

The cloth panel 23*a* has on its external face and over its full height tongues 23*i*, 23*j* disposed in the vicinity of the areas of connection with the cloth panels 23*b* and 23*d*, respectively, of the envelope 24. The tongues 23*i* and 23*j* provide a lateral seal when they are in contact with the corresponding taut straps 16, 17 of the guiding device 15.

The cloth panel 23*a* can equally include in its lower portion at least one opening 23*k*, not shown, for security cells.

Figure 6:
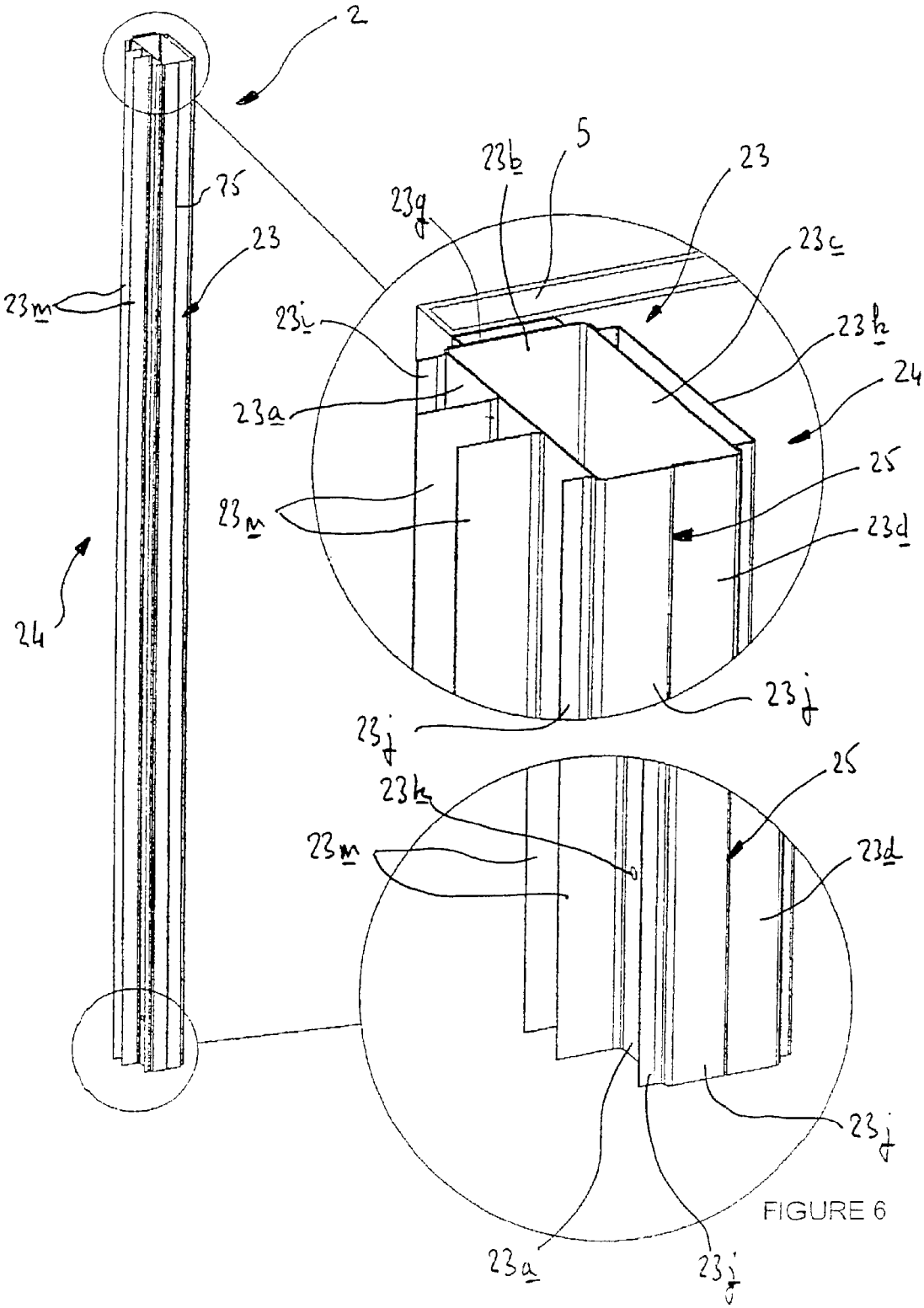

The cloth panel 23*a* can equally include in the middle and over its full height one or two other central tongues 23*m* providing a lateral seal when they are in contact with the edges of the flexible curtain 6 of the service door when it moves between an open position and a closed position. In this case, the cloth panel 23*a* can include in its lower portion and between the tongues 23*i*, 23*j* and the central tongues 23*m* at least one opening 23*k* for security cells that are not shown (FIG. 6).

The envelope 24 can consist of a cloth 23 produced from a double-skin fabric solving the problems of heat exchange and icing up if the service door 1 is installed in a cold room.

The envelope 24 can equally consist of a cloth 23 produced from an ATEX class fabric enabling use of the service door 1 in areas where there is a risk of explosion.

The envelope 24 can equally consist of a cloth 23 produced from an Mo, M1 or M2 class fabric enabling use of the service door 1 in areas where there is a risk of fire.

Thus the structure of the vertical uprights 2, 3 means that they are quick to install and reduces their weight.

Note that the envelope 24 of each modular upright 2, 3 can be produced in a cloth 23 that is of exactly the same color as that used for the flexible curtain 6.

It is found that the structure consisting of the assembly of elements constituting each upright 2, 3 of the service door 1 makes it very resilient, i.e. highly resistant to impact, because of the elastic deformation of each of its elements.

It must furthermore be understood that the foregoing description has been given by way of example only and that it is in no way limiting on the scope of the invention, which would not be exceeded by replacing the details of execution described by any equivalent other such details.

The invention claimed is:

1. A modular vertical upright for a service door (1), said service door having a horizontal box section (4) provided with lateral flanges (19) configured to retain a driving drum (7) and to guide a rotation of the drum (7) during movement of a flexible curtain (6) between an open position and a closed position, comprising:

an upper plate (18) to be fastened to the lateral flange (19) of the horizontal box section (4), a lower plate (20) to be fixed to the ground, a central core (21) comprising at least one tubular vertical structural section (22), the central core connecting the upper plate (18) and the lower plate (20) together, an envelope (24) extending over a full height of the central core (21), comprising a cloth (23) fixed around the upper plate (18), the lower plate (20), and an entirety of the central core (21) between the upper plate (18) and the lower plate (20), and a guiding device (15) constituting a slide for movement of the flexible curtain (6), wherein each of the central core, the cloth, and the guiding device (21, 23, 15) is formed of an elastically deformable material in order to make the service door (1) highly resistant to impact, and wherein the at least one tubular vertical structural section (22) of the central core (21) is formed of one of the group consisting of: composite material of high elasticity, plastic material of high elasticity, and steel having a high elastic limit.

2. The modular vertical upright according to claim 1, wherein the central core (21) consists of four tubular structural sections (22) that are parallel in pairs, the first two tubular structural sections (22) whereof produce the framework of the vertical upright (2, 3) while the other two tubular structural sections (22) guide and house a counterweight (26).

3. The modular vertical upright according to claim 1, wherein the cloth (24) is formed of a single-skin or double-skin technical fabric similar to that used for the flexible curtain (6).

4. The modular vertical upright according to claim 1, wherein the envelope (24) consists of a cloth (23) with cloth panels (23*a*, 23*b*, 23*c*, 23*d*) arranged and fixed together by welding to follow the dimensions and the external contour of the upper plate (18) and the lower plate (20) so as to cover them and the central core (21) of the modular upright (2, 3).

5. The modular vertical upright according to claim 4, wherein an external face of the cloth panel (23*b*) has, over a full height of the cloth panel (23*b*), a bead (23*g*) providing a seal with the face (5) of the wall.

6. The modular vertical upright according to claim 4, wherein an external face of the cloth panel (23*c*) has, over a full height of the cloth panel (23*c*), a housing (23*h*) through which electrical cables can be passed.

7. The modular vertical upright according to claim 4, wherein an entire height of the cloth panel (23*d*) has a slit to form two half-panels (23*e*, 23*f*) for delimiting an entry for fitting the envelope (24) around the upper plate (18) and the lower plate (20).

8. The modular vertical upright according to claim 7, wherein the two half-panels (23*e*, 23*f*) are connected together by closure means (25) for retaining the envelope (24) around the upper plate (18) and the lower plate (20).

9. The modular vertical upright according to claim 4, wherein an external face of the cloth panel (23*a*) has, over a full height of the cloth panel (23*a*), tongues (23*i*, 23*j*) disposed in the vicinity of the connecting areas with the cloth panels (23*b*, 23*d*), respectively, in order to provide a lateral seal when they are in contact with taut straps (16, 17) of the guiding device (15).

10. The modular vertical upright according to claim 9, wherein, at a middle of the cloth panel (23*a*), the cloth panel (23*a*) has, over a full height of the cloth panel (23*a*), one or two other central tongues (23*m*) providing a lateral seal when the central tongues (23*m*) are in contact with the edges of the flexible curtain (6) of the service door (1).

11. The modular vertical upright according to claim 10, wherein a lower portion of the cloth panel (23*a*) has, between the tongues (23*i*, 23*j*) and the central tongues (23*m*), at least one opening (23*k*) through which security cells can pass.

12. A modular vertical upright for a service door (1), said service door having a horizontal box section (4) provided with lateral flanges (19) configured to retain a driving drum (7) and to guide a rotation of the drum (7) during movement of a flexible curtain (6) between an open position and a closed position, comprising:

an upper plate (18) to be fastened to the lateral flange (19) of the horizontal box section (4), a lower plate (20) to be fixed to the ground, an impact-resistant central core element (21) comprising at least one tubular vertical structural section (22) each comprising a topmost end secured to the upper plate (18) and a bottommost end secured to the lower plate (20), an envelope (24) extending over and around the central core element across a full height of the central core element (21), the envelope (24) comprising a cloth (23) affixed to the upper plate (18) and the lower plate (20), and completely surrounding the upper plate (18), the lower plate (20), and an entirety of the central core element (21) between the upper plate (18) and the lower plate (20), and a guiding device (15) constituting a slide for movement of the flexible curtain (6), wherein each of the central core element, the cloth, and the guiding device (21, 23, 15) is elastically deformable in order to make the service door (1) highly resistant to impact, and wherein the at least one tubular vertical structural section (22) of the central core (21) is formed of an impact-resistant elastic material.

13. The modular vertical upright according to claim 12, wherein the at least one tubular vertical structural section (22) of the central core (21) is formed of one of the group consisting of: composite material of high elasticity, plastic material of high elasticity, and steel having a high elastic limit.

14. The modular vertical upright according to claim 12, wherein the central core element (21) comprises at least two vertical, tubular, impact-resistant structural members (22).

15. The modular vertical upright according to claim 14, wherein the at least two vertical, tubular, impact-resistant structural members are made of steel with an elastic limit sufficient to return to an original shape after an impact.

16. The modular vertical upright according to claim 14, wherein the at least two vertical, tubular, impact-resistant structural members are made of a composite material with an elastic limit sufficient to return to an original shape after an impact.

17. The modular vertical upright according to claim 14, further comprising:

a counterweight (26) slideably mounted on two of the at least two vertical, tubular, impact-resistant structural members.

18. The modular vertical upright according to claim 12, wherein the cloth (23) comprises a plurality of cloth panels (23*a*, 23*b*, 23*c*, 23*d*) arranged and fixed together by welding to follow the dimensions and the external contour of the upper plate (18) and the lower plate (20) so as to cover them and the central core element (21) of the modular upright (2, 3).

19. The modular vertical upright according to claim 18, wherein an entire length of one of the cloth panels (23*d*) is slit thereby to form two half-panels (23*e*, 23*f*) for delimiting an entry for fitting the envelope (24) around the upper plate (18) and the lower plate (20).

20. The modular vertical upright according to claim 19, wherein the two half-panels (23*e*, 23*f*) are connected together by closure means (25) for retaining the envelope (24) around the upper plate (18) and the lower plate (20).

* * * * *

UNITED STATES PATENT AND TRADEMARK OFFICE

CERTIFICATE OF CORRECTION

PATENT NO. : 8,439,100 B2
APPLICATION NO. : 12/668071
DATED : May 14, 2013
INVENTOR(S) : Panseri et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 360 days.

Signed and Sealed this
Eighth Day of September, 2015

Michelle K. Lee

Michelle K. Lee
*Director of the United States Patent and Trademark Office*